US008856980B2

(12) United States Patent
Eriksson

(10) Patent No.: US 8,856,980 B2
(45) Date of Patent: Oct. 14, 2014

(54) UNDER MUD SHOWER PAN

(76) Inventor: Leonard Eriksson, Oxnard, CA (US)

( * ) Notice: Subject to any disclaimer, the term of this patent is extended or adjusted under 35 U.S.C. 154(b) by 504 days.

(21) Appl. No.: 12/789,432

(22) Filed: May 27, 2010

(65) Prior Publication Data

US 2010/0299827 A1 Dec. 2, 2010

Related U.S. Application Data

(60) Provisional application No. 61/181,644, filed on May 27, 2009.

(51) Int. Cl.
*A47K 3/00* (2006.01)
*A47K 3/40* (2006.01)

(52) U.S. Cl.
CPC ..... *A47K 3/40* (2013.01)
USPC ..... 4/613

(58) Field of Classification Search
USPC ..... 4/612–614; 52/35
See application file for complete search history.

(56) References Cited

U.S. PATENT DOCUMENTS

| | | | | |
|---|---|---|---|---|
| 4,557,004 | A * | 12/1985 | Piana | 4/613 |
| 6,419,238 | B2 * | 7/2002 | McComb | 277/630 |
| 2006/0026752 | A1 * | 2/2006 | Torres | 4/613 |

* cited by examiner

*Primary Examiner* — Huyen Le
*Assistant Examiner* — Janie Christiansen
(74) *Attorney, Agent, or Firm* — John Alumit

(57) ABSTRACT

The invention relates to a one-piece shower pan with no openings for water leakage, other than the drain hole, and designed for easy installation of tiles of various thicknesses. The shower pan comprises a drain hole designed to fit a conventional drain pipe such that when the conventional drain pipe is fastened to the shower pan, the conventional drain pipe extends ½ to 2 inches above the bottom of the shower pan. In this way, when cement or other adhesive is floated on the interior surface of the shower pan, tiles of varying thickness can be installed in such a manner that the top surface of the tiles are substantially flush with the top portion of the conventional drain pipe. The shower pan also has a waterdam with a fin extending vertically on the outer edge of the waterdam as added protection against water migration outside the shower pan.

6 Claims, 3 Drawing Sheets

UNDER MUD SHOWER PAN

CROSS-REFERENCE TO RELATED APPLICATION

This application claims the benefit of provisional application No. 61/181,644 filed on May 27, 2009.

FEDERALLY SPONSORED RESEARCH

None

SEQUENCE LISTING OR PROGRAM

None

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

The present invention relates in general to shower pans, and more particularly, to a prefabricated under mud shower pan that allows for tiles of varying thickness to be installed on the interior surface of the shower pan, and for added protection against water migration.

Most shower pans are either custom-made or have a drain pipe already built into the shower pan. The problem with these is that it is difficult to install tiles in the interior surface of the shower pan. This can be due to several problems. First, some shower pans comprise curvatures that are not designed for placement of tile on them. Second, other shower pans have a drain pipe pre-installed in the shower pan so that if tiles were placed on the interior surface of the shower pan, they would not be flush with the drain pipe, making the horizontal floor area of the shower pan appear awkward. Third, custom-made shower pans with tiles pre-installed are limited to the tiles available to the manufacturer. Fourth, while it may be possible to glue tiles onto a shower pan, one cannot control the elevation of the tiles by floating cement over the surface of the shower pan, including the waterdam. Home builders or remodelers would not have the flexibility of installing tiles of their choosing, such as imported tiles, nor control the elevation of the tiles placed on the shower pan.

Various types of shower pans are known. U.S. Pat. No. 6,990,695 issued to Grayson describes a shower pan for mounting in a shower stall that includes a single integrally molded base with a drain hole. A sidewall extends upward from the base and completely surrounds the base. A lateral ledge extends outward from the sidewall and has an inner edge and an outer edge defining a surface therebetween for mounting a shower stall door track. An outer ridge extends upward from the outer edge of the lateral ledge and is in spaced-apart relation to the door track. Water flowing through cracks between the door track and the shower pan is prevented from escaping the shower pan by the outer ridge, which allows water to drain under the door track into the shower pan. However, due to the curvatures in Grayson, it is not possible to install tiles. Furthermore, Grayson is not designed to be used with a conventional drain pipe.

U.S. Pat. No. 6,003,169 issued to Davis, Jr describes a prefabricated, custom-built shower pan with a drain hole for use in a shower stall. The shower pan comprises an acrylic-based, solid surface upper layer; a polystyrene foam layer and a planar base layer with raised edges. The polystyrene foam layer is framed by the base layer and covered by the acrylic-based, solid surface upper layer. Also provided is a shower pan comprising an acrylic-based, solid surface upper layer; a base layer comprising a planar base with raised edges, a system of stringers, and a water dam. The stringers are substantially straight, horizontal wooden supports which collectively incline toward the drain hole. They are relatively evenly distributed within and adhere to the rectangular-shaped base. Each stringer has an incline on its upper surface, and one end abutting one edge of the base. However, Davis is a custom-built shower pan. It is not a shower pan that allows for a conventional drain pipe to be inserted in the drain hole such that the drain pipe rises approximately ½ to 2 inches above the horizontal surface of the shower pan, allowing for tiles of various thickness to be installed in a manner that the top of the tiles are flush with the top portion of the drain pipe.

U.S. Pat. No. 4,541,132 issued to Long describes a shower pan which forms a base of a shower stall. It has a one piece drain surface and is capable of being built in various sloping configurations. The shower pan is constructed of a top drain panel supported by graduated shims and perimeter strips which are in turn mounted on a planar foundation. Perimeter strips and graduated shims are secured to the foundation, concentrically spaced apart, surrounding a variably located drain opening. The top drain panel is cut to the same contour and size as the foundation and has a rear member, side members, and threshold members to provide lateral water barriers. Kerfed break lines in the top drain panel permit the panel to bend to form a basin like drain surface. The top drain panel is positioned and pressed down onto the shims at perimeter strips forming a drain basin with sloping panel sections defined by the kerfed break lines. A waterproof material such as hot mop tar is applied to the interior surfaces of the shower pan. An adhesive is then applied to all exposed surfaces and a finish covering such as ceramic tile or cultured marble is applied to the shower pan. The problem with Long is that it is comprised of separate pieces (side members and rear members) which create potential openings for water to escape, thereby requiring the need for a hot mop tar for waterproofing. Furthermore, the drain wipe does not rise up sufficiently high above the shower floor surface to allow for different tile sizes to be used, and the drain hole may not be suited for conventional drain pipes.

It is an object of the present invention to provide a one-piece shower pan without openings for water leakage, that is designed for easy installation of tiles of various thickness, having a drain hole designed to fit a conventional drain pipe such that the pipe rises anywhere from ½ inch to 2 inches above the shower floor surface to accommodate tiles of varying thickness so that the top surface of the tiles are substantially flush with the top portion of the drain pipe, and with an additional fin on the waterdam to prevent water migration outside the shower pan should water seep past the tile and cement. Other objects of the present invention will become better understood with reference to appended Summary, Description and Claims.

SUMMARY

The present invention is a one piece prefabricated shower pan that is designed for easy installation of tiles of various thickness, having a drain hole designed to fit a conventional drain pipe such that the pipe rises anywhere from ½ inch to 2 inches above the shower floor surface to accommodate tiles of varying thickness so that the top of the tiles are substantially flush with the top portion of the drain pipe. The prefabricated shower pan comprises a horizontal floor area and a drain hole positioned substantially on a center portion. The horizontal floor area is gradually inclined towards the drain hole. The prefabricated shower pan further includes a pair of opposing sidewalls extending upwardly from a peripheral edge of the horizontal floor area and a third sidewall extending upwardly from the peripheral edge of the horizontal floor area. The third sidewall is in contact with a back end of the pair of opposing sidewalls. The pair of opposing sidewalls and the third sidewall are arranged to form a rectangular shape.

The prefabricated shower pan further includes a waterdam extending upwardly from the peripheral edge of the horizontal floor area. The waterdam has a lower height relative to the pair of opposing sidewalls and the third sidewall. The waterdam is in contact with a front end of the pair of opposing sidewalls. The prefabricated shower pan has no openings other than the drain hole for water to escape. The interior surface of the prefabricated shower pan has a sand-finished surface to provide good bonding with cement or other adhesive for placing shower tiles. The shower tiles can also be placed over a wall system inserted inside the shower pan.

Although particular embodiments of the present invention have been described in the foregoing description, it is to be understood that the present invention is not to be limited to just the embodiments disclosed, but that they are capable of numerous rearrangements, modifications and substitutions without departing from the description herein.

REFERENCE NUMERALS

Figure 1:
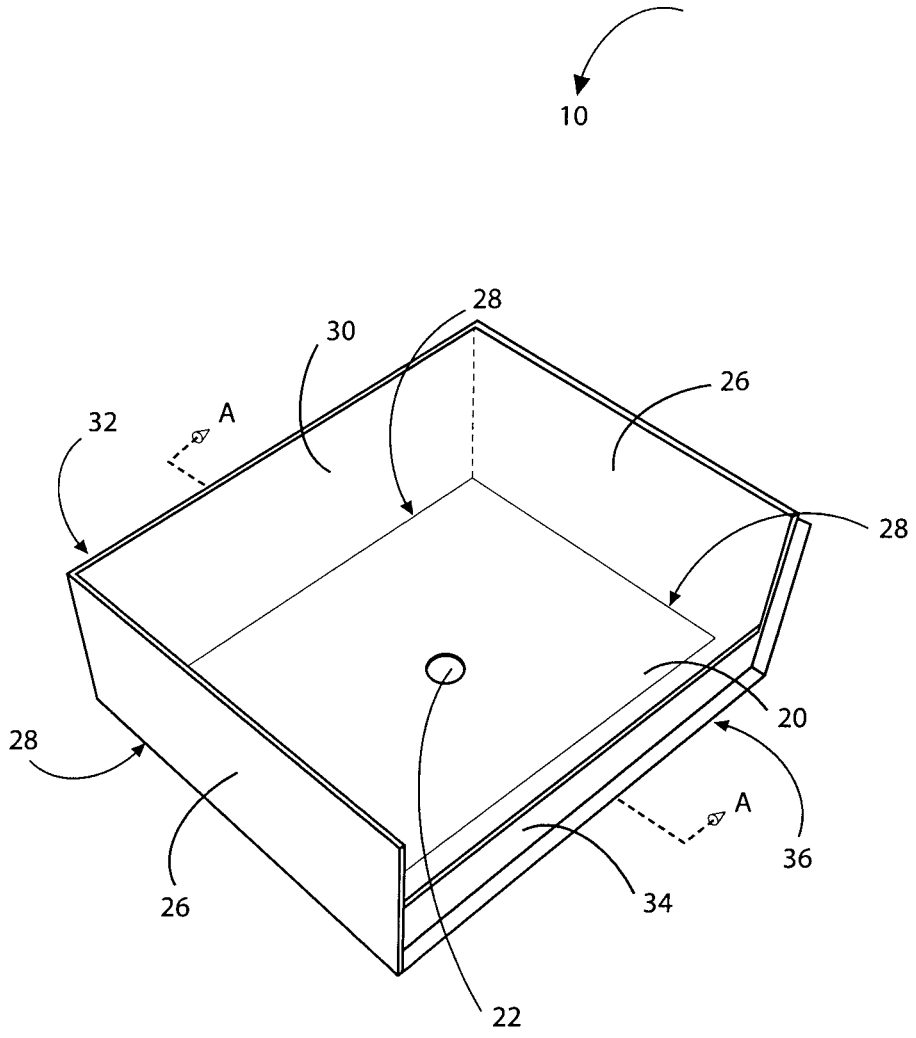
FIG. 1 is a perspective view of the present invention, illustrating a one-piece prefabricated shower pan with no drain pipe pre-installed.

10 . . . A prefabricated shower pan
20 . . . A horizontal floor area
22 . . . At least one drain hole
24 . . . conventional drain pipe
26 . . . A pair of opposing sidewalls
28 . . . A peripheral edge of the horizontal floor area
30 . . . A third side wall
32 . . . A back end of the pair of opposing sidewalls
34 . . . waterdam
35 . . . fin
36 . . . A front end of the pair of opposing sidewalls
40 . . . cement or adhesive
42 . . . Tiles
45 . . . Depression
46 . . . A walling system
47 . . . Troughs
48 . . . A layer of butyl tape wrap

DETAILED DESCRIPTION

Referring to the drawings, a preferred embodiment illustrates a prefabricated shower pan 10 designed for tiling and with additional protection against water migration outside the shower pan and generally indicated in FIGS. 1 *through* 3.

Referring to FIG. 1, the prefabricated shower pan 10 comprises a pair of opposing sidewalls 26 extending upwardly from a peripheral edge 28 of a horizontal floor area 20 and a third sidewall 30 extending upwardly from the peripheral edge 28 of the horizontal floor area 20 so that the side walls and the horizontal floor area form a near 90 degree angle. The angle is a near 90 degree angle because the horizontal floor area is inclined toward the center portion of the shower pan so that, depending on the extent of the incline, the angle formed by the meeting of the sidewalls and the horizontal floor area can be 90 degrees or more. The third sidewall 30 is in contact with a back end 32 of the pair of opposing sidewalls 26. The pair of opposing sidewalls 26 and the third sidewall 30 are arranged to form a rectangular shape.

Still referring to FIG. 1, the horizontal floor area 20 has at least one drain hole 22 positioned substantially on a center portion. The circumference of the drain hole 22 is wide enough for a conventional drain pipe 24 to be inserted through it and a depression (shown in FIG. 2 as 45) borders the drain hole 22 so that a conventional drain pipe 24 can be fastened to the horizontal floor area 20 with flanges.

Figure 2:
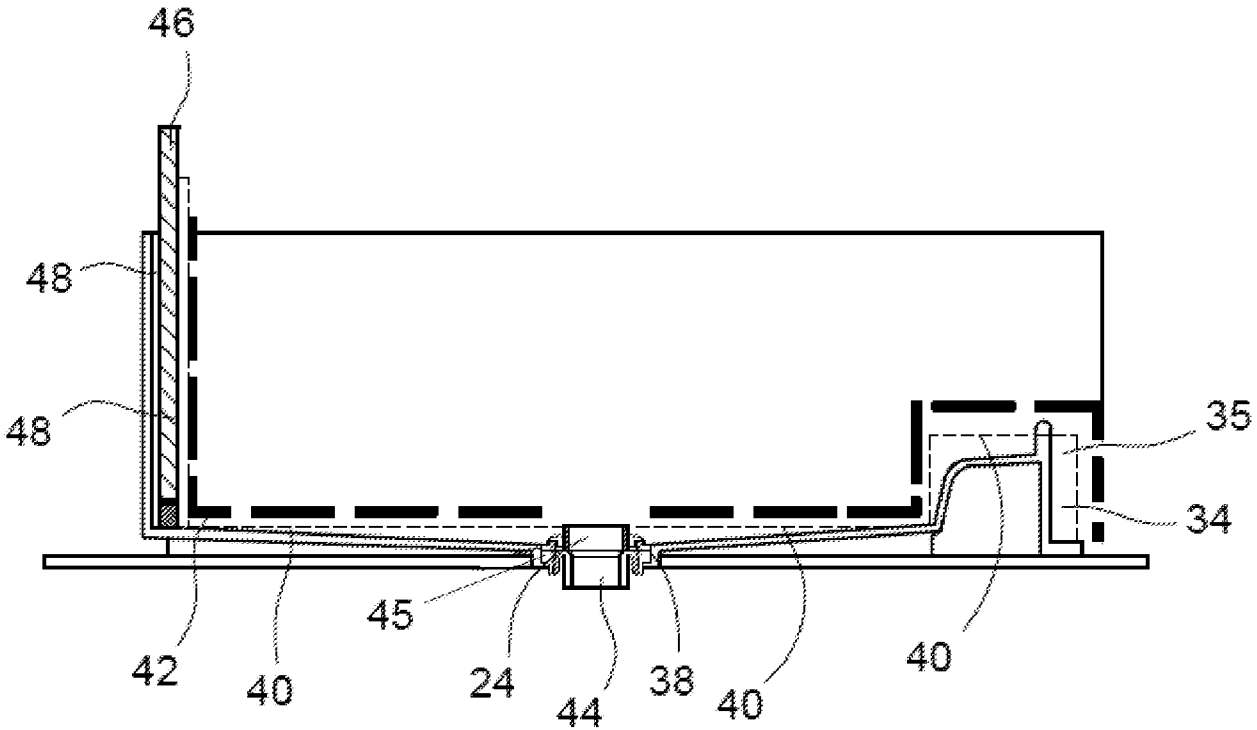
FIG. 2 is a sectional view of the present invention taken generally along the lines A-A of FIG. 1.
Figure 3:
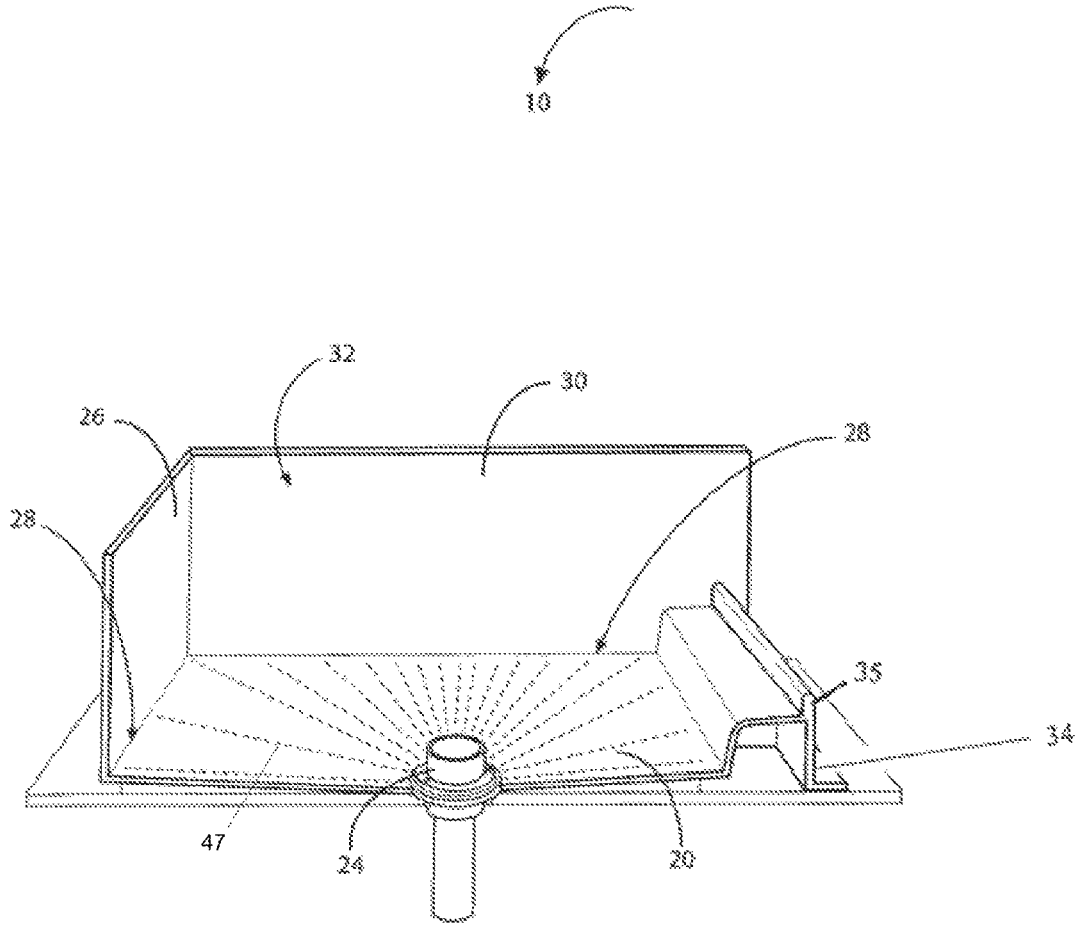
FIG. 3 is a cut-away view of the present invention, illustrating a conventional drain pipe fastened to the surface of the horizontal floor area of the shower pan.

FIG. 2 is a cross sectional view of the preferred embodiment generally taken along the lines A-A of FIG. 1. FIG. 3 is a cut-away view of the present invention, illustrating a conventional drain pipe 24 fastened to the surface of the horizontal floor area 20 of the shower pan 10.

Referring to FIGS. 2 and 3, when a conventional drain pipe 24 is inserted through the drain hole and fastened to the shower pan (using flanges 38 and weep holes), at least ½ to 2 inches of the pipe extends above the interior surface of the horizontal floor area. In this way, cement or other adhesive 40 can be floated on the interior surface of the horizontal floor area and tiles of varying thickness can be placed on top of the cement or other adhesive 40 such that the top surface of the tiles are even with the top portion of the conventional drain pipe 24. Allowing for a drain pipe to extend beyond the interior surface of the horizontal floor area by ½ to 2 inches allows for tiles of varying thickness to be placed on the horizontal floor area. The more thin a tile is, the more cement or adhesive will be required so that the top surface of the tile will be even with the top of the conventional drain pipe, and the more thick a tile is, the less cement or adhesive would be used to make the top of the tile substantially flush with the top portion of the conventional drain pipe 24. Since the horizontal floor area is inclined toward the center portion of the shower pan, it is more important that the tiles bordering the drain hole are substantially flush with the top portion of the conventional drain pipe. Cement or other adhesive 40 is also placed over the waterdam.

In FIG. 2, the broken lines simulate the placement of tile on cement or other adhesive 40 so that the top of the tiles are flush with the top of the conventional drain pipe 24. In a preferred embodiment, the horizontal floor area 20 of the prefabricated shower pan 10 has a sand finished surface (not shown) to provide good bonding with cement or other adhesive for placing shower tiles (not shown).

FIG. 2 shows how tile is placed over a walling system 46 used in conjunction with the shower pan, wherein the walling system 46 is inserted in the inside of at least one sidewall of the shower pan and wrapped in butyl tape 48 to ensure a strong bond and create a water proof barrier to prevent water migration up the wall system 46. The wall system can be a foam-based backer board.

Referring to FIGS. 2 and 3, the horizontal floor area 20 is gradually inclined towards the drain hole 22.

With reference to FIGS. 1, 2, and 3, the prefabricated shower pan 10 further includes a waterdam 34 extending upwardly from the at least one peripheral edge 28 of the horizontal floor area 20. The waterdam 34 has a lower height relative to the pair of opposing sidewalls 26 and the third sidewall 30. The waterdam 34 is in contact with a front end 36 of the pair of opposing sidewalls 26. The top surface of the waterdam 34 is sloped inward toward the center portion of the shower pan 10. In addition, the waterdam 34 has a fin 35 extending vertically on its outside edge to provide additional protection against water migration outside the shower pan in the event water penetrates the overlaid tile and cement. In this way, migrating water will fall back into the shower pan.

In an alternate embodiment, troughs 46 jut outwardly from the drain hole 22 to facilitate the exit of water down the drain hole 22.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A one-piece prefabricated shower pan consisting of:

a horizontal floor area having at least one drain hole positioned substantially on a center portion thereof, the horizontal floor area being gradually inclined towards the at least one drain hole;

a pair of opposing sidewalls extending upwardly from a peripheral edge of the horizontal floor area at a near 90 degree angle;

a third sidewall extending upwardly from the peripheral edge of the horizontal floor area at a near 90 degree angle, the third sidewall being in contact with a back end of the pair of opposing sidewalls;

a water dam extending upwardly from the at least one peripheral edge of the horizontal floor area, wherein the at least one drain hole has a circumference that allows for a conventional drain pipe to be inserted through it and a depression around the borders of the drain hole to allow a conventional drain pipe to be fastened to the horizontal floor area with the use of flanges, such that when the conventional drain pipe is fastened to the horizontal floor area, approximately one half to two inches of the conventional drain pipe extends above the horizontal floor area, and wherein there are no openings in the shower pan for water to escape, other than the drain.

2. The one-piece prefabricated shower pan of claim 1, wherein the water dam has a lower height relative to the pair of opposing sidewalls and the third sidewall.

3. The one-piece prefabricated shower pan of claim 1, wherein the water dam has a top surface slanted toward the center of the shower pan and a fin extending vertically from the outside edge of the water dam to safeguard against water migration outside the shower pan.

4. The one-piece prefabricated shower pan of claim 1, wherein the prefabricated shower pan has a substantially rectangular structure.

5. A one-piece prefabricated shower pan consisting of:

a horizontal floor area having at least one drain hole positioned substantially on a center portion thereof, the horizontal floor area being gradually inclined towards the at least one drain hole;

a pair of opposing sidewalls extending upwardly from a peripheral edge of the horizontal floor area at a near 90 degree angle;

a third sidewall extending upwardly from the peripheral edge of the horizontal floor area at a near 90 degree angle, the third sidewall being in contact with a back end of the pair of opposing sidewalls;

a water dam extending upwardly from the at least one peripheral edge of the horizontal floor area, wherein the at least one drain hole has a circumference that allows for a conventional drain pipe to be inserted through it and a depression around the borders of the drain hole to allow a conventional drain pipe to be fastened to the horizontal floor area with the use of flanges, such that when the conventional drain pipe is fastened to the horizontal floor area, approximately one half to two inches of the conventional drain pipe extends above the horizontal floor area, wherein there are no openings in the shower pan for water to escape, other than the drain; and wherein troughs jut outwardly from the at least one drain hole to facilitate the exit of water down the drain hole.

6. A one-piece prefabricated shower pan consisting of:

a horizontal floor area having at least one drain hole positioned substantially on a center portion thereof, the horizontal floor area being gradually inclined towards the at least one drain hole;

a pair of opposing sidewalls extending upwardly from a peripheral edge of the horizontal floor area at a near 90 degree angle;

a third sidewall extending upwardly from the peripheral edge of the horizontal floor area at a near 90 degree angle, the third sidewall being in contact with a back end of the pair of opposing sidewalls;

a water dam extending upwardly from the at least one peripheral edge of the horizontal floor area, wherein the at least one drain hose has a circumference that allows for a conventional, drain pipe to be inserted through it and a depression around the borders of the drain hole to allow a conventional drain pipe to be fastened to the horizontal floor area with the use of flanges, such that when the conventional drain pipe is fastened to the horizontal floor area, approximately one half to two inches of the conventional drain pipe extends above the horizontal floor area, wherein there are no openings in the shower pan for water to escape, other than the drain, and wherein a depression borders the at least one drain hole so that a conventional drain pipe can be fastened to the horizontal floor area with flanges.

* * * * *